US005776578A

United States Patent [19]

Dejaynes

[11] Patent Number: 5,776,578

[45] Date of Patent: Jul. 7, 1998

[54] NOVELTY DEVICE

[76] Inventor: Arnold M. Dejaynes, R.R. #1, Box 168, New London, Iowa 52645

[21] Appl. No.: 797,693

[22] Filed: Jan. 31, 1997

[51] Int. Cl.[6] ..... B32B 1/08; B32B 3/10

[52] U.S. Cl. ..... 428/66.6; 428/12; 428/542.2; 428/542.6; 428/136; 446/489

[58] Field of Search ..... 428/4, 8, 9, 12, 428/136, 542.2, 542.6, 66.6; 446/487, 489

[56] References Cited

U.S. PATENT DOCUMENTS

| | | | |
|---|---|---|---|
| 3,637,455 | 1/1972 | Pearson et al. | 428/4 |
| 4,143,199 | 3/1979 | Bardon et al. | 428/369 |
| 4,201,806 | 5/1980 | Cole | 428/4 |
| 4,366,199 | 12/1982 | Grosjean | 428/114 |
| 4,515,837 | 5/1985 | Cheng | 428/4 |
| 4,656,064 | 4/1987 | Cheng | 428/4 |
| 4,684,552 | 8/1987 | Labrosse et al. | 428/4 |
| 4,822,648 | 4/1989 | Cheng | 428/4 |
| 4,863,284 | 9/1989 | Cheng | 383/18 |
| 4,886,687 | 12/1989 | Malott | 428/4 |

*Primary Examiner*—Alexander Thomas
*Attorney, Agent, or Firm*—Zarley, McKee, Thomte, Voorhees, & Sease

[57] ABSTRACT

A novelty design apparatus has an elongated body member with an outer surface and first and second ends. An elongated body member has an outer surface and first and second ends. A flexible elongated tube is slidably mounted on the outer surface of the body member. One end of the tube is secured to the first end of the body member with the remainder of the tube slidably and rotatably embracing the body member. The central portion of the tube has a plurality of elongated slits which expand into a variety of design configurations when the free end of the tube is rotated, and slidably moved towards the fixed end of the tube. A guard element or disk is secured to the elongated body member to prevent the expanded central portion of the tube from being crushed or distorted when the novelty member is placed on a flat surface with the elongated tube in its expanded position.

3 Claims, 2 Drawing Sheets

NOVELTY DEVICE

BACKGROUND OF THE INVENTION

Kaleidoscopes and the like which present varied designs and ornamentations pleasing to the eye have long been popular to both adults and children. However, these devices are unable to present these designs in three dimensions, and do not permit the persons operating the device to use their own imaginations to create varied designs.

It is therefore a principal object of this invention to provide a novelty device that permits the creation of varied three dimensional designs which are pleasing to the eye.

A further object of the invention is to provide a novelty device which will permit the user to create a variety of physical three-dimensional designs.

A still further object of the invention is to provide a novelty device which can be easily stored, packaged, or shipped without destroying its full functional purpose upon being used.

These and other objects will be apparent to those skilled in the art.

SUMMARY OF THE INVENTION

An elongated body member has an outer surface and first and second ends. A flexible elongated tube is slidably mounted on the outer surface of the body member. One end of the tube is secured to the first end of the body member with the remainder of the tube slidably and rotatably embracing the body member. The central portion of the tube has a plurality of elongated slits which expand into a variety of design configurations when the free end of the tube is rotated, and slidably moved towards the fixed end of the tube. A guard element or disk is secured to the elongated body member to prevent the expanded central portion of the tube from being crushed or distorted when the novelty member is placed on a flat surface with the elongated tube in its expanded position.

DESCRIPTION OF THE PREFERRED EMBODIMENT

Figure 1:
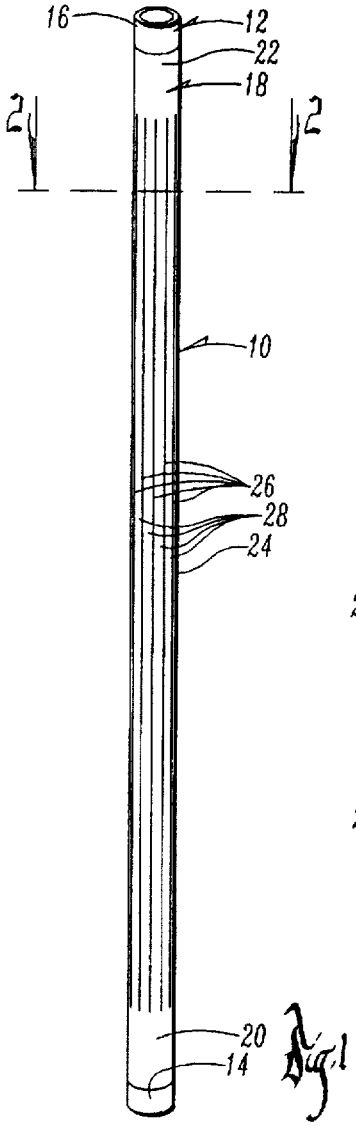
FIG. 1 is a perspective view of the device of this invention.
Figure 2:
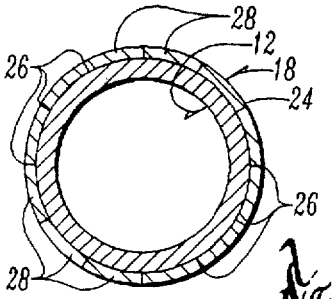
FIG. 2 is an enlarged scale sectional view taken on line 2—2.

The novelty device 10 includes a hollow tube 12 constructed of paper or the like which typically is about ⅜ ths of an inch in diameter and approximately 8" long. Body member 12 has a first end 14 and a second end 16. The body member preferably is cylindrical in shape.

A tube 18 comprised of light, flexible, ribbon-like material is mounted on the outer surface of body member 12 and has an interior diameter substantially equal to the outer diameter of the body member. Tube 18 has a first end 20 which is fixed to the first end 14 of body member 12 by a suitable adhesive (not shown). Tube 18 has a second end 22 and a central portion 24 which slidably and rotatably embrace the body member. The central portion 24 has a plurality of elongated longitudinal slits 26 which create a plurality of elongated ribbon portions 28.

Figure 3:
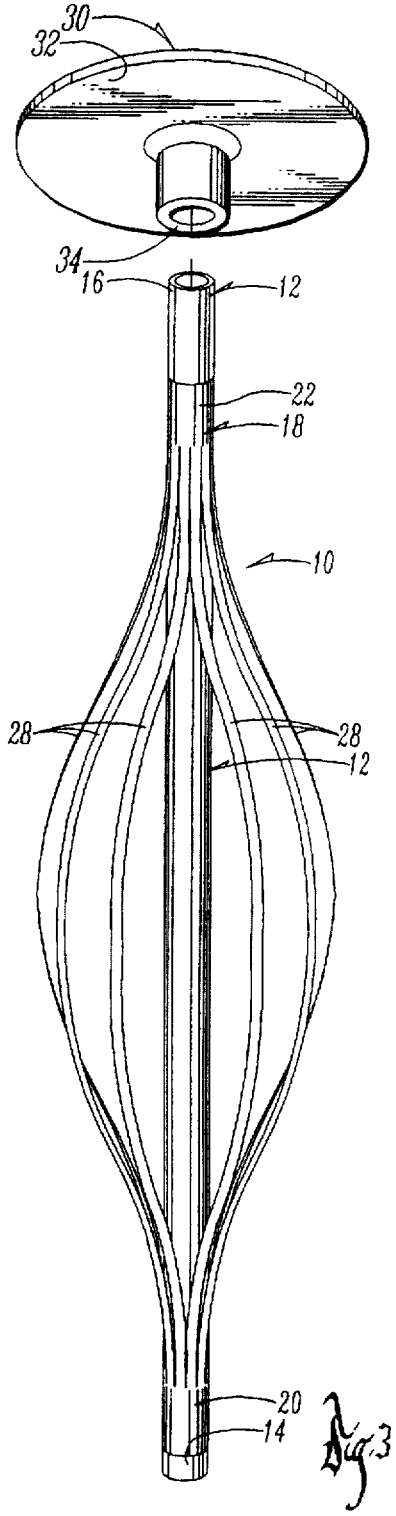
FIG. 3 is a perspective view similar to that of FIG. 1 but with the tube in an adjusted position with respect to the position of FIG. 1.
Figure 4:
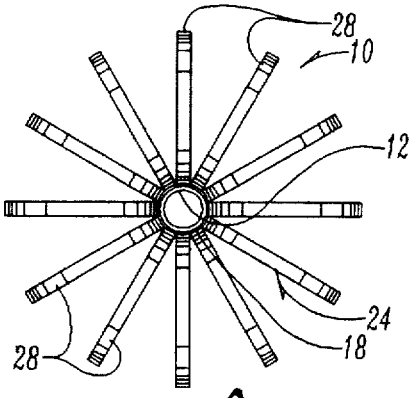
FIG. 4 is an end elevational view of the device of FIG. 3.
Figure 5:
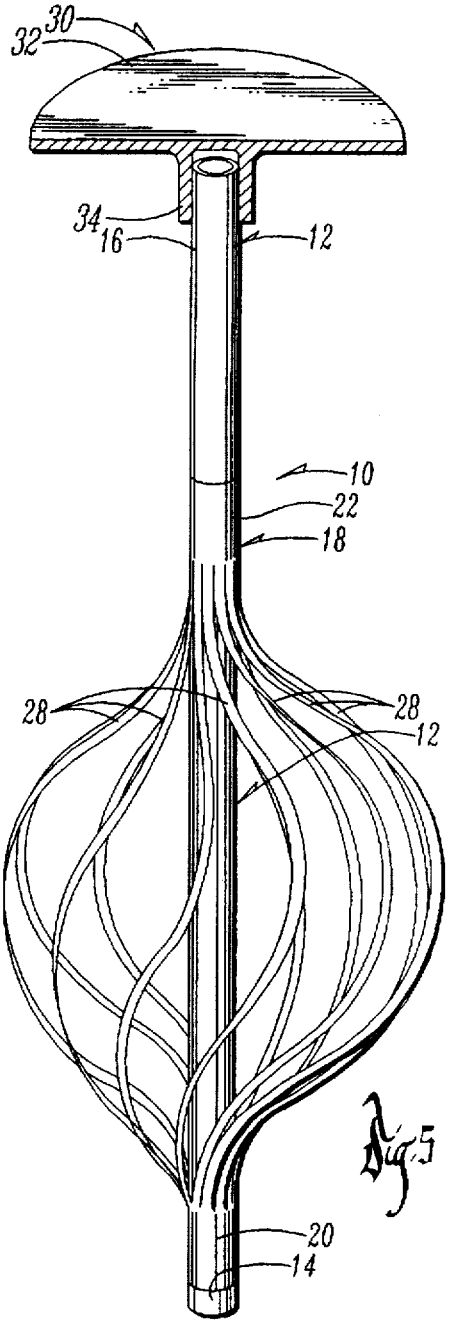
FIG. 5 is a further modified configuration similar to that of FIG. 3, but with the tube in a first rotated position on the body member.
Figure 6:
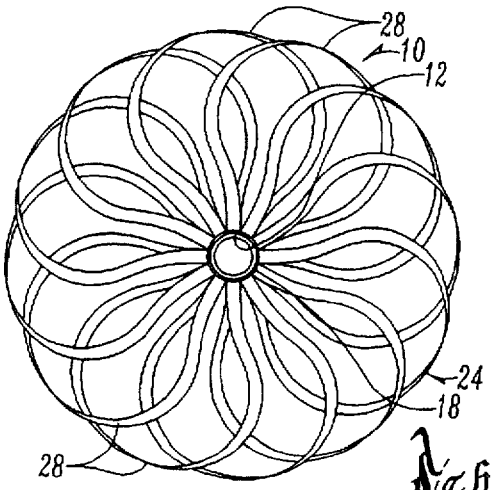
FIG. 6 is an end elevational view of the device of FIG. 5.

The device is normally in the configuration shown in FIG. 1. In operation, the operator typically would grasp the first end 14 of body member 12 in one hand, and the other hand would grasp the second end 22 of tube 18. By sliding the second end of tube 22 towards the first end 20, the ribbon portions 28 will be moved away from the body member into a longitudinally shortened and cross-sectionally inflated decorative configuration of FIGS. 3 and 4. FIGS. 5 and 6 show the design created when the end 22 of tube 18 is slidably moved even further towards fixed end 20, and whereupon the second end 22 is rotated on the body member.

A circular guard element 30 comprising a circular disk 32 and a hollow stem 34 is glued or otherwise secured to the first end 14 of body member 12. The end 14 is invited into the stem 34. It is immaterial as to whether the end 20 of tube 18 also extends into item 34. The diameter of disk 32 is at least as great if not greater than the diameter of the expanded inflated decorative configuration of the ribbon portions 28 of FIG. 5.

It is seen that a plurality of design configurations can be created by adjusting the slidable and rotatable position of the second end 22 of tube 18 on the body member 12. By continually reciprocating the slidable position of the second end 22 on the body member 12, the design configurations will have continuous movement which creates a further pleasing effect.

It is preferred that the color of the tube 18 be different than the color of the body member 12, for this also adds to the decorative effect.

It is seen that the diameter of disk 32 will prevent the expanded ribbon portions 28 from being crushed or distorted if the novelty device 10 is placed on a flat surface with the ribbon portions 28 in their expanded position, because the disk 32 will prevent the body member 12 from moving into a coplanar position with a supporting surface.

It is therefore seen that the device of the invention will accomplish at least its stated objectives.

What is claimed is:

1. A novelty device, comprising, an elongated body member having an outer surface and first and second ends, a flexible elongated tube slidably mounted on the outer surface of said body member, said tube having a central portion and first and second ends normally positioned adjacent the first and second ends of said body member, said central portion of said tube having a plurality of elongated slits to create a plurality of elongated ribbon portions, said first end of said tube being fixed to said first end of said body member, and said second end of said tube being rotatably and slidably mounted on said second end of said body member so that by sliding said second end of said tube towards said first end of said tube, and by rotating said second end of said tube, said ribbon portions will be moved away from said body member into an expanded longitudinally shortened and cross-sectionally inflated decorative configuration; and a disk element on the first end of said body member to lift said body member away from a flat supporting surface to protect said ribbon portions from being distorted when said novelty device is placed on a flat supporting surface when said ribbon portions are in a position away from said body member.

2. The device of claim 1 wherein said disk is circular in shape.

3. The device of claim 2 wherein the disk has a diameter at least as great as the effective diameter of said ribbon portions when said ribbon portions are moved to said inflated decorative configuration.

* * * * *